United States Patent [19]

Ikeda et al.

[11] Patent Number: 4,471,073

[45] Date of Patent: Sep. 11, 1984

[54] HEAT-SENSITIVE RECORDING MATERIALS

[75] Inventors: Kensuke Ikeda; Akira Igarashi; Takekatsu Sugiyama; Hiroharu Matsukawa, all of Shizuoka, Japan

[73] Assignee: Fuji Photo Film Co., Ltd., Kanagawa, Japan

[21] Appl. No.: 435,863

[22] Filed: Oct. 21, 1982

[30] Foreign Application Priority Data

Oct. 21, 1981 [JP] Japan ..... 56-168142

[51] Int. Cl.[3] ..... B41M 5/18

[52] U.S. Cl. ..... 346/208; 346/209

[58] Field of Search ..... 282/27.5; 427/150, 151; 428/320.8, 488, 537, 913, 914, 411

[56] References Cited

FOREIGN PATENT DOCUMENTS 57-8194 1/1982 Japan ..... 503/208

57-14094 1/1982 Japan ..... 503/209

*Primary Examiner*—Bruce H. Hess

*Attorney, Agent, or Firm*—Sughrue, Mion, Zinn, Macpeak, and Seas

[57] ABSTRACT

A heat-sensitive recording paper which is comprised of a support base having a heat-sensitive color forming layer thereon is disclosed. The layer contains a colorless or faint color electron donating dye, a bisphenol and a straight chain fatty acid amide. The recording sensitivity of the paper is greatly increased by incorporating a phenol derivative having the general formula

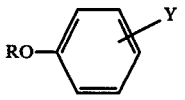

wherein R is an alkyl group or an aralkyl group and Y represents a phenyl group, an alkyl group, a cycloalkyl group or a halogen atom.

14 Claims, No Drawings

HEAT-SENSITIVE RECORDING MATERIALS

FIELD OF THE INVENTION

This invention relates to heat-sensitive recording sheets and, more particularly, to heat-sensitive recording sheets having high heat sensitivity and response speed.

BACKGROUND OF THE INVENTION

Colored images can be obtained by reacting an electron donating colorless dye (hereinafter, is referred to as color former) and an electron accepting compound (hereinafter, is referred to as color developer) in the presence of heat energy. An example of a means to obtain such an image is disclosed in U.S. Pat. No. 3,539,375 and Japanese Patent Publication No. 4160/68. Heat-sensitive recording sheets utilizing the same basic principles may be very useful as recording papers for facsimile machines.

The speed of facsimile recording machines and the speed of their print out with heat-sensitive elements have increased substantially making it necessary to have heat-sensitive recording materials which respond in a shorter period of time, i.e., heat-sensitive materials with highly sensitized recording sensitivity.

The term "recording sensitivity" as used herein refers to the relationship of heat energy applied to a heat-sensitive recording layer and the density of the image formed. A material has high sensitivity if the heat-sensitive recording material produces a high density image by applying a small amount of energy. A material has low sensitivity if the heat-sensitive recording material requires the application of a large amount of energy to obtain a sufficiently dense image.

There are shown methods of increasing recording sensitivity of heat-sensitive recording materials by incorporating various materials in the heat-sensitive color forming layers. The incorporation of sensitivity-improving agents is proposed in Japanese Patent Application (OPI) Nos. 19231/73, 48751/78, 62189/81, etc. (the term "OPI" as used herein refers to a "published unexamined Japanese patent application"). The recording sensitivity may be increased by using a bisphenol as a color developer, or by the addition of a straight chain fatty acid amide as a third material.

Sensitivity can only be increased to a limited extent by using a straight chain fatty acid amide as a sensitizing agent. Therefore, market requirements cannot be satisfied by the mere addition of the straight chain fatty acid amide.

SUMMARY OF THE INVENTION

A primary object of this invention is to provide a heat-sensitive recording material having high sensitivity as compared to conventional heat-sensitive recording materials.

The objects of this invention have been attained by heat-sensitive recording material having a heat-sensitive color forming layer containing a colorless or faint color electron donating dye and a bisphenol capable of coloring the electron donating dye upon heating, said heat-sensitive color forming layer containing a straight chain fatty acid amide and a phenol derivative represented by the following general formula (I):

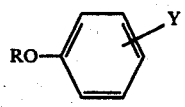

(I)

wherein R represents an alkyl group or an aralkyl group and Y represents a phenyl group, an alkyl group, a cycloalkyl group, or a halogen atom.

DETAILED DESCRIPTION OF THE INVENTION

Practical examples of bisphenols used as a color developer in this invention are 1,1-bis(p-hydroxyphenyl)-2-ethyl-butane, 2,2-bis(p-hydroxyphenyl)propane, 2,2-bis(p-hydroxyphenyl)pentane, 2,2-bis(p-hydroxyphenyl)hexane, 2,2-bis(4-hydroxy-3,5-dichlorophenyl)-propane, 1,1-bis(p-hydroxyphenyl)cyclohexane, 1,1-bis(4-hydroxy-5-chlorophenyl)cyclohexane, etc. The preferred examples of the bisphenols are a bisphenol compound represented by the following general formula:

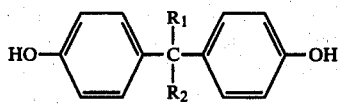

wherein $R_1$ and $R_2$ each represents an alkyl group containing 1 to 12 carbon atoms or $R_1$ and $R_2$ together represent a carbocyclic ring or a derivative of such compound.

The heat-sensitive color forming layer of the present invention must contain three components (a bis bisphenol as a color developer, a phenol derivative shown by general formula (I), and a straight chain fatty acid) together with a color former. If any one of these components is lacking, the improved results of the present invention are greatly reduced.

The color former used in connection with the present invention is a material such as a leuco dye and many leuco dyes are used as colorless dyes for pressure-sensitive recording papers. These dyes color by causing reactions with color developers in the presence of heat energy. Examples of color formers used in this invention include aminophthalide, triarylmethane compounds, phenylmethane compounds, xanthene compounds, thiazine compounds and spiropyran compounds.

Practical examples of the triarylmethane compounds include 3,3-bis(p-dimethylaminophenyl)-6-dimethylaminophthalide (i.e., Crystal Violet lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide and 3-p-dimethylaminophenyl-3-(1-methylpyrrol-2-yl)-6-dimethylaminophthalide.

Examples of the diphenylmethane compounds include 4,4'-bis-dimethylaminobenzhydrinbenzyl ether, N-halophenyl-leucoauramine, N-2,4,5-trichlorophenyl-leucoauramine.

Examples of the xanthene compounds include 2-benzylamino-3-diethylaminofluoran, 2-butylamino-3-diethylaminofluoran, 2-methoxy-3-diethylaminofluoran, 3-diethylamino-7,8-benzofluoran, 2-(2'-chloroanilino)-6-diethylaminofluoran, 2-anilino-3-chloro-6-diethylaminofluoran, 2-anilino-3-methyl-7-diethylaminofluoran, 2-anilino-3-methyl-7-tolylethylaminofluoran, 2-anilino-3-methyl-7-cyclohexylmethylaminofluoran, 2-(3'-fluoroanilino)-7-diethylaminofluoran and 2-β-ethoxyethylamino-3-chloro-7-diethylaminofluoran.

Examples of the thiazine compounds include benzyl Leucomethylene Blue, o-nitrobenzyl Leucomethylene Blue.

Examples of the spiro compounds include 3-methyl-spiro-dinaphthopyran, 3-ethyl-spiro-dinaphthopyran, 3,3'-dichloro-spiro-dinaphthopyran, 3-benzylspiro-dinaphthopyran, 3-methylnaphtho-(3-methoxybenzo)-spiropyran and 3-propyl-spiro-dibenzopyran.

These compounds may be used alone or as a mixture of them and the use of the triarylmethane compounds and the xanthene compounds such as fluoran compounds is particularly preferred for obtaining high coloring density.

Preferred examples of straight chain fatty acid amides used in this invention include stearic acid amide, palmitic acid amide, erucic acid amide, oleic acid amide and ethylenebis-stearoamide. Higher fatty acid amides having 12 to 24 carbon atoms are particularly preferred, more preferably a higher fatty acid amides having 16 to 20 carbon atoms. The foregoing fatty acid amides may be used alone or as a mixture of two or more of such fatty acid amides.

With respect to the phenol derivatives represented by the foregoing general formula (I), the alkyl group represented by R preferably has 1 to 20 carbon atoms, more preferably 1 to 10 carbon atoms. The aralkyl group represented by R preferably has 7 to 20 carbon atoms. Particularly preferred examples include a benzyl group or a phenethyl group.

The alkyl group represented by Y in the foregoing general formula (I) preferably has 1 to 15 carbon atoms, more preferably 1 to 8 carbon atoms. Preferred examples of the cycloalkyl group shown by Y include a cyclohexyl group or a cyclopentyl group. The preferred halogen atom represented by Y is a chlorine atom.

With respect to the phenol derivative represented by the foregoing general formula (I), the substituent Y may be disposed at the ortho-position, meta-position or para-position to the OR group but the para-position is particularly preferred.

Preferred examples of phenol derivatives represented by general formula (I) have a melting point of 40° to 150° C. Those having a melting point of 50° to 120° C. are particularly preferred.

Practical examples of the phenol derivatives used in this invention are shown below, although the invention is not limited to them.

The examples include p-tolyl p-chlorobenzyl ether, p-tolyl p-isopropylbenzyl ether, p-t-butylphenyl benzyl ether, p-t-butylphenyl-p-isopropyl benzyl ether, p-t-amylphenyl benzyl ether, p-t-amyl-p-isopropyl benzyl ether, p-t-octylphenyl benzyl ether, p-t-octylphenyl-p-isopropyl benzyl ether, n-hexyl p-biphenyl ether, n-octyl p-biphenyl ether, benzyl-p-biphenyl ether, 4-bromobutyl p-biphenyl ether, 5-chloroamyl-p-biphenyl ether, p-isopropylbenzyl p-biphenyl ether, β-phenethyl p-biphenyl ether, α-phenetil p-biphenyl ether, p-isopropylbenzyl p-biphenyl ether, β-ethoxyethyl p-biphenyl ether, β-n-butoxyethyl p-biphenyl ether, p-cyclohexylphenyl benzyl ether and p-cyclohexylphenyl p-isopropylbenzyl ether.

The straight chain fatty acid amide and the phenol derivative used in this invention are dispersed in a dispersion medium (the amide and phenol derivative are in particle sizes of less than 10μ) by means of a ball mill, etc. Alternatively, they may be simultaneously added when dispersing the color former and/or the color developer in a dispersion medium by means of a ball mill. The straight chain fatty acid amide is added to increase the sensitivity by utilizing the eutectic effect with the bisphenol. Accordingly, it is preferred to mix the straight fatty acid amide and the bisphenol in fused states under heating and, after crushing the solidified mixture, disperse them by means of a ball mill. Alternatively, dispersing may be preferably carried out by the method shown in Japanese Patent Application No. 110942/80. In particular, the latter method is preferred with respect to improving workability and other properties. When performing these operations, the phenol derivative shown by general formula (I) may be simultaneously added to the system.

The color former, color developer, and sensitivity-increasing agents used in this invention are dispersed in a dispersion medium in particle sizes of less than 10μ. The dispersion medium may be an aqueous solution if a water-soluble high molecular compound present in a concentration of about 1 to 10% by weight. The medium can be used for dispersing the components in a device such as a ball mill, a sand mill or a colloid mill.

The ratio of the color former to the color developer used is preferably 1:10 to 1:1 by weight ratio, more preferably 1:5 to 2:5. With respect to sensitivity-increasing agents used in connection with this invention, straight chain fatty acid amides are preferably added based on the amount of the bisphenol as the developer in an amount of 20 to 300% by weight, more preferably 50 to 150% by weight. It is preferred to add a phenol derivative shown by the foregoing general formula in an amount of 20 to 300% by weight, in particular, 40 to 150% by weight, based on the weight of the color developer.

If sensitivity-increasing agents are added in an amount of less than 20% by weight based on the amount of bisphenol, the sensitivity increasing effect is insufficient. However, if more than 300% by weight based on the amount of bisphenol is added, the heat capacity of the system increases too much, resulting in reduced sensitivity.

The coating composition of the heat-sensitive layer may contain other additives to meet various requirements.

Examples of such additives include an oil-absorbing material such as an inorganic pigment dispersed in a binder for preventing a recording head from being stained during recording and a fatty acid or metal soap added to increase the lubricating property of the head. The heat-sensitive recording material is generally prepared by coating the support with additives such as a pigment or a wax together with the color former and color developer. The additives can directly contribute to coloring.

Useful pigments include kaolin, calcined kaolin talc, agalmatolite, diatomaceous earth, calcium carbonate, aluminum hydroxide, magnesium hydroxide, magnesium carbonate, titanium oxide, barium carbonate, a urea-formalin filler and a cellulose filler. Useful waxes include paraffin wax, carnauba wax, microcrystalline wax and polyethylene wax, etc., as well as higher fatty acid esters.

Useful metal soaps include polyvalent metal salts of higher fatty acids, such as zinc stearate, aluminum stearate, calcium stearate and zinc oleate.

These materials are coated in the form of a dispersion in a binder. A water-soluble binder is generally used. Useful binders include polyvinyl alcohol, hydroxyethyl cellulose, hydroxypropyl cellulose, ethylene-maleic anhydride copolymer, styrene-maleic anhydride copolymer, isobutylene-maleic anhydride copolymer, polyacrylic acid, polyacrylic acid amide, starch derivatives, casein and gelatin. These binders may be combined with a water resisting agent such as gelling agent or cross-linking agent as well as an emulsion of a hydrophilic polymer such as a styrene-butadiene rubber latex or an acryl resin emulsion.

Then, the examples of this invention are shown below but the invention is not, as a matter of course, limited by them.

EXAMPLE 1

Dispersion A

To an aqueous solution of 5% polyvinyl alcohol (polymerization degree: 500 and saponification degree: 99%) was added 20 g of 2-β-ethoxyethylamino-3-chloro-6-diethylaminofluoran (a color former) and the mixture was dispersed for 10 hours by means of a ball mill.

Dispersion B

After completely fusing and mixing 100 g of 2,2-bis(p-hydroxyphenyl)propane and 100 g of stearic acid amide in an oil bath heated to 150° C., the mixture was quenched in water and the 1:1 eutectic mixture of 2,2-bis(p-hydroxyphenyl)propane and stearic acid amide thus obtained was crushed into a mean particle size of 300 μm and added to 500 g of an aqueous solution of 5% polyvinyl alcohol followed by dispersing for 24 hours by means of a ball mill.

Dispersion C

To 500 g of an aqueous solution of 5% polyvinyl alcohol was added 100 g of β-phenethyl p-biphenyl ether and the mixture was dispersed for 24 hours by means of a ball mill.

Dispersion A, Dispersion B, and Dispersion C were mixed with each other and after adding thereto 250 g of calcined kaolin and 400 g of an aqueous solution of 10% polyvinyl alcohol, the resulting mixture was dispersed for 5 hours in a ball mill. The coating solution thus obtained was coated on a base paper of 50 g/m$^2$ at a dry coverage of 7.5 g/m$^2$ using a wire bar. The coated paper was dried to provide a heat-sensitive recording material of this invention.

EXAMPLE 2

Dispersion D

To an aqueous solution of 5% polyvinyl alcohol (polymerization degree: 500 and saponification degree: 99%) was added 20 g of 2-anilino-3-methyl-6-cyclohexylmethylaminofluoran (a color former) and the mixture was dispersed for 10 hours by means of a ball mill.

Dispersion E

After completely fusing and mixing 100 g of 2,2-bis(p-hydroxyphenyl)propane, 50 g of stearic acid amide and 50 g of palmitic acid amide in an oil bath heated to 150° C., the mixture was quenched in water. The resulting eutectic mixture of 2,2-bis-(p-hydroxyphenyl)propane, the stearic acid amide and palmitic acid amide thus obtained was crushed into a mean particle size of 300μ and added to 500 g of an aqueous solution of 5% polyvinyl alcohol followed by dispersing for 24 hours by means of a ball mill.

Dispersion F

To 500 g of an aqueous solution of 5% polyvinyl alcohol was added 100 g of benzyl p-biphenyl ether and the mixture was dispersed for 24 hours by means of a ball mill.

Dispersion D, Dispersion E and Dispersion F were mixed with each other and after adding thereto 250 g of calcined kaolin and 400 g of an aqueous solution of 10% polyvinyl alcohol, the resulting mixture was dispersed for 5 hours in a ball mill. The coating solution thus obtained was coated on a base paper of 50 g/m$^2$ at a dry coverage of 7.5 g/m$^2$ using a wire bar. The coated paper was dried to provide a heat-sensitive recording material of this invention.

COMPARATIVE EXAMPLE 1

The same procedure as in Example 1 was followed except that Dispersion C was not used. Accordingly, a comparative heat-sensitive recording material was obtained.

COMPARATIVE EXAMPLE 2

The same procedure as in Example 2 was followed except that Dispersion F was not used. Accordingly, another comparative heat-sensitive recording material was obtained.

The whole surface of each of the heat-sensitive recording materials thus obtained in the examples and the comparative examples was colored while changing the applied pulse width and the applied potential, that is, while changing the applied energy of a facsimile (EF-22R, made by Matsushita Graphic Communication Systems, Inc.). The relations between the coloring densities and the applied energies are shown in Table 1.

The results clearly show that the heat-sensitive recording materials of this invention have high sensitivity as compared with conventional heat-sensitive recording materials.

TABLE 1

| Run No. | Coloring Density[1*] | | |
|---|---|---|---|
| | 20[2*] | 30[2*] | 40[2*] |
| Example 1 | 0.56 | 1.04 | 1.27 |
| Example 2 | 0.58 | 1.05 | 1.30 |
| Comparative Example 1 | 0.20 | 1.50 | 0.98 |
| Comparative Example 2 | 0.21 | 0.52 | 1.00 |

[1*]The coloring density was measured by a Machbeth RD-514 type reflection densitometer using a visual filter.
[2*]Applied energy (mj/mm$^2$)

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material, comprising:

a support base; and a heat-sensitive color forming layer on the support base, the layer being comprised of the following components:

(a) a colorless or faint color electron donating dye;

(b) a bisphenol capable of creating a color upon contacting the electron donating dye in the presence of heat;

(c) a straight chain fatty acid amide, present in an amount of 20 to 300 percent by weight based on the weight of component (b); and (d) a phenol derivative represented by the general formula (I):

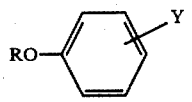

(I)

wherein R is an alkyl group or an aralkyl group and Y is a phenyl group, an alkyl group, a cycloalkyl group, or a halogen atom, said phenol derivative being present in an amount of 20 to 300% by weight based on the weight of component (b), and wherein components (a) to (d) have particle sizes less than 10μ.

2. A heat-sensitive recording material as claimed in claim 1, wherein the straight chain fatty acid amide is a higher fatty acid amide having 12 to 24 carbon atoms.

3. A heat-sensitive recording material as claimed in any of claims 1 or 2, wherein R is an alkyl group containing 1 to 20 carbon atoms or an aralkyl group containing 7 to 20 carbon atoms.

4. A heat-sensitive recording material as claimed in claim 3, wherein R is an alkyl group containing 1 to 10 carbon atoms.

5. A heat-sensitive recording material as claimed in claim 1, wherein R is a benzyl group or a phenethyl group.

6. A heat-sensitive recording material as claimed in claim 1, wherein Y is an alkyl group containing 1 to 15 carbon atoms.

7. A heat-sensitive recording material as claimed in claim 6, wherein Y is an alkyl group containing 1 to 8 carbon atoms.

8. A heat-sensitive recording material as claimed in claim 1, wherein Y is a cyclohexyl group or a cyclopentyl group.

9. A heat-sensitive recording material as claimed in claim 1, wherein Y is a chlorine atom.

10. A heat-sensitive recording material as claimed in claim 1, wherein the Y group is disposed at the ortho-position, meta-position or para-position to the OR group.

11. A heat-sensitive recording material as claimed in claim 10, wherein the Y group is disposed at the para-position to the OR group.

12. A heat-sensitive recording material as claimed in claim 1, wherein the phenol derivative has a melting point of from 40° to 150° C.

13. A heat-sensitive recording material as claimed in claim 12, wherein the phenol derivative has a melting point of from 50° to 120° C.

14. A heat-sensitive recording material as claimed in claim 1, wherein the phenol derivative is present in an amount of 40 to 150% by weight based on the weight of the color developer.

* * * * *